United States Patent [19]

Inculet et al.

[11] Patent Number: 4,673,132

[45] Date of Patent: Jun. 16, 1987

[54] SPRAYING APPARATUS

[75] Inventors: Ion I. Inculet; George S. P. Castle, both of London, Canada

[73] Assignee: Canadian Patents and Development Limited, Ottawa, Canada

[21] Appl. No.: 363,306

[22] Filed: Mar. 29, 1982

Related U.S. Application Data

[63] Continuation of Ser. No. 102,954, Dec. 12, 1979, abandoned.

[30] Foreign Application Priority Data

Jan. 22, 1979 [CA] Canada ..... 320155

[51] Int. Cl.[4] ..... B05B 5/02

[52] U.S. Cl. ..... 239/706; 239/77

[58] Field of Search ..... 239/3, 77, 78, 690, 239/691, 695, 705, 706, 707, 704

[56] References Cited

U.S. PATENT DOCUMENTS

| | | | |
|---|---|---|---|
| 3,212,211 | 10/1965 | Bennett | 239/706 |
| 3,265,306 | 8/1966 | Fischer et al. | 239/707 |
| 3,339,840 | 9/1967 | Point | 239/695 |
| 3,504,854 | 4/1970 | De Kinkelder | 239/78 |
| 3,698,635 | 10/1972 | Sickles | 239/3 |
| 3,964,683 | 6/1976 | Gimple | 239/691 |
| 4,004,733 | 1/1977 | Law | 239/3 |
| 4,190,875 | 2/1980 | Smart et al. | 239/706 |

*Primary Examiner*—Andres Kashnikow
*Assistant Examiner*—Michael J. Forman
*Attorney, Agent, or Firm*—Edward Rymek

[57] ABSTRACT

Spraying apparatus comprising a shroud in the form of a tube flared at one end and made of electrical insulating material, said shroud adapted for connection to an air supply such that in operation a high velocity air stream issues from the flared end of the shroud, at least one air shear nozzle mounted inside the shroud adjacent the flared end, a tube adapted for connection to a liquid spray source for supplying the nozzle such that in operation the liquid is atomized by the high velocity air flow and the expansion of compressed air from the supply passing over the nozzle, means for maintaining the liquid in the nozzle at ground electrical potential, a high voltage metal electrode positioned inside the flared end of the shroud in spaced relation to the nozzle, and means for supplying high voltage to the electrode such that in operation the electrode carries a high voltage positive or negative potential effective to charge by induction liquid particles or droplets issuing from the said nozzle.

2 Claims, 3 Drawing Figures

SPRAYING APPARATUS

This application is a continuation of application Ser. No. 06/102,954 filed Dec. 12, 1979, now abandoned.

This invention relates to spraying apparatus and more particularly to an improved spraying nozzle used in such apparatus.

A crop sprayer in use at the present time consists of one or more shrouds mounted on a vehicle, each facing in a direction at some angle to the direction of travel. Inside each of the shrouds are a number of wedge type nozzles fed by the liquid to be atomized and sprayed. A compressor blows high velocity air (100–250 mph) through the shrouds past the nozzles. In the process the liquid is atomized into very fine droplets.

The objects of the present invention are to provide apparatus that will (a) improve the atomization by producing a more uniform droplet size distribution, of a smaller mean diameter, (b) produce a more uniform dispersion of the droplets in the atomized cloud, and (c) provide an attraction force to the leaf surface on both the front and back of the leaf.

These objects of the invention are achieved by spraying apparatus comprising a shroud in the form of a tube flared at one end and made of electrical insulating material, said shroud adapted for connection to an air supply such that in operation a high velocity air stream issues from the flared end of the shroud, at least one air shear nozzle mounted inside the shroud adjacent the flared end, a tube adapted for connection to a liquid spray source for supplying the nozzle such that in operation the liquid is atomized by the high velocity air flow passing over the nozzle means for maintaining the nozzle at ground electrical potential, a high voltage metal electrode positioned inside the flared end of the shroud in spaced relation to the nozzle, and means for supplying high voltage to the electrode such that in operation the electrode carries a high voltage positive or negative potential effective to charge by induction liquid particles or droplets issuing from the said nozzle.

Various types of agriculture spraying and dusting apparatus using electrostatic techniques are well known. Typical apparatus is shown in the following U.S. Pat. Nos. 3,141,259 W. R. Winters, July 21, 1964; 3,195,264, R. G. Ward Jr., July 20, 1965; 3,212,211, R. P. Bennett, Oct. 29, 1965; 3,339,840, M. A. R. Point, Sept. 5, 1967; 3,521,125, R. H. Nelson, July 21, 1970.

These patents are concerned with electrostatic spraying employing corona charging of the sprayed material and not with induction charging with an air shear nozzle as described here.

In drawings which illustrate an embodiment of the invention,

Figure 1:
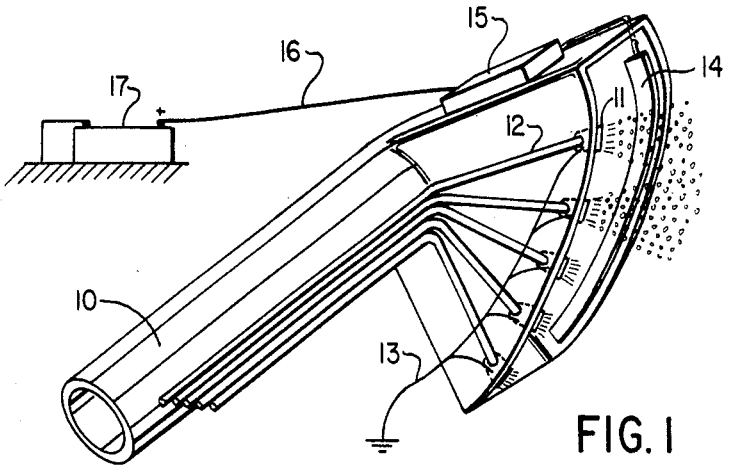
FIG. 1 shows a sprayer shroud with atomizing nozzles and induction charging of droplets.

Referring to FIG. 1, a spraying shroud 10 has a series (5 shown) of wedge-shaped air shear nozzles 11 mounted on an edge of the shroud as shown. These nozzles are connected via supply tubes 12 to the spraying liquid supply (not shown). The shroud is connected to an air compressor (not shown) providing a high speed (in the range 100–250 mph) flow of air past the nozzles to the exterior exterior atomizing the liquid emerging from the nozzles. The apparatus is normally mounted on a tractor or other form of vehicle. This type of spraying apparatus is described in U.S. Pat. No. 3,504,854 issued Apr. 7, 1970 to P. J. A. De Kinkelder.

In standard sprayers of this type, the shroud is of metal. In the described apparatus according to the invention this portion of the device is made of insulating material, e.g. hard plastic material. Tubes 12 are also of non-conducting material but the liquid feed is maintained at ground potential such that nozzles 11 may be maintained at ground. Alternatively a separate ground line 13 may be connected to the nozzles. A high voltage metallic strip 14 is attached to the inside of the shroud facing the nozzles. This strip which may be a single elongated strip or a series of short electrically interconnected strips or plates is maintained at a positive or negative high electrical potential (e.g. −3 to 50 kV) by means of a high voltage power pack 5 requiring insignificant power because the charging action is induction charging and which can be made sufficiently small to be incorporated in or close to the actual shroud and fed by a low voltage line 16 from the battery 17 of the tractor (e.g. 12–25 V).

Because the power pack is located near the strip, the reliability of the apparatus is much enhanced.

Figure 2:
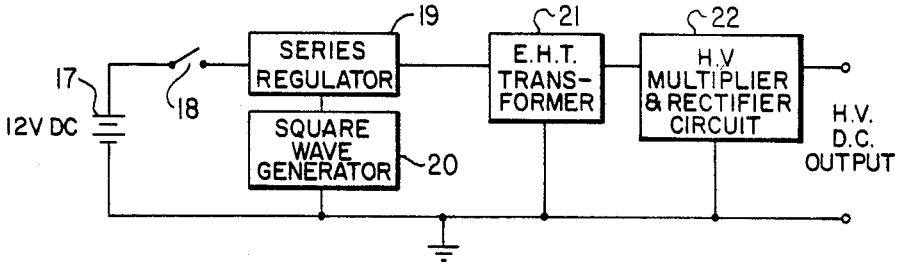
FIG. 2 is a circuit diagram of a typical power supply.

A typical power pack circuit is shown in FIG. 2. The 12 V DC current from the tractor battery 17 passes via switch 18 to a series regulator 19 and a square wave generator 20 which in effect give an AC output to E.H.T. transformer 21. The output of this is fed to H.V. multiplier and rectifier circuit 22 which multiplies and rectifies the voltage giving a H.V. DC output which is applied to the electrode strip. Other types of H.V. supply may be used e.g. automobile ignition type devices.

Figure 3:
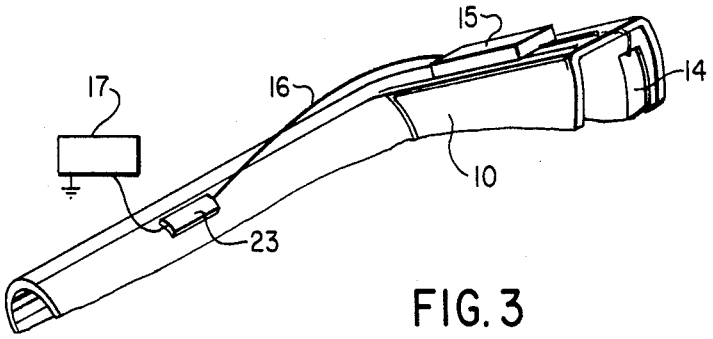
FIG. 3 shows a pressure switch safety feature.

An additional safety feature may be used. FIG. 3 shows this wherein low voltage line 16 from the battery 17 to the H.V. power pack is taken through a pressure switch 23 mounted in the side of the shroud 10 and operative such that when the high velocity air flow through the shroud is cut off the switch disconnects the input to the power pack.

The liquid particles issuing from the nozzles acquire an electric charge by induction. The charge is of a polarity opposite to that of the high voltage metallic strip. This charging provides an electrostatic spraying effect.

The combination of induction charging with a high volume, high velocity air flow entraining the charged droplets, proved to be highly effective in generating large, electrically charged, aerosol clouds. Such aerosol clouds, when formed over large areas to be sprayed, are far more effective than the technology used in electrostatic painting. An electrostatic painting gun uses the electrical field generated by its antenna to propel the paint particles towards the area to be painted. Potentials of 100,000 volts are barely sufficient at distances of one or two feet. A charged cloud such as produced by the described apparatus is equivalent to generating propelling electric fields far greater than anything that may be achieved with one electrostatic painting gun.

The high velocity air flow passing through the shroud has the beneficial effect of keeping the electrode strip clean and dry.

We claim:

1. Spraying apparatus comprising:

(a) a shroud in the form of a tube flared and flattened at one end to define a generally rectangular, elongated end opening and made of electrical insulating material, said shroud adapted for connection to an air supply such that in operation a high velocity air stream issued from the end opening of the shroud, (b) a multiplicity of air shear nozzles mounted inside the shroud and arranged in a plane adjacent the end opening, (c) tube adapted for connection to a liquid spray source for supplying each of the nozzles such that in operation the liquid is atomized by the high velocity air flow passing over the nozzles, (d) means for maintaining the liquid in said nozzles at ground electrical potential.

(e) high voltage planar electrode means consisting of an elongated flat strip, positioned inside the flared end of the shroud in spaced relation to the nozzles, and (f) means for supplying high voltage to the electrode means such that in operation the electrode means carries a high voltage positive or negative potential effective to charge by induction liquid particles or droplets issuing from the said nozzles.

2. Spraying apparatus as claimed in claim 1 wherein the air shear nozzles are arranged in an arc adjacent the end opening and the elongated flat strip is arcuate in the plane of the flat strip.

* * * * *